US009009880B2

(12) United States Patent
Wedi

(10) Patent No.: US 9,009,880 B2
(45) Date of Patent: Apr. 21, 2015

(54) COVER BOX FOR A SHOWER FLOW SYSTEM

(75) Inventor: Stephan Wedi, Emsdetten (DE)

(73) Assignee: wedi GmbH, Emsbetten (DE)

( * ) Notice: Subject to any disclaimer, the term of this patent is extended or adjusted under 35 U.S.C. 154(b) by 330 days.

(21) Appl. No.: 13/537,456

(22) Filed: Jun. 29, 2012

(65) Prior Publication Data

US 2013/0000034 A1 Jan. 3, 2013

(30) Foreign Application Priority Data

Jul. 1, 2011 (DE) ..... 10 2011 051 496

(51) Int. Cl.
*A47K 3/00* (2006.01)
*E03F 5/04* (2006.01)

(52) U.S. Cl.
CPC ..... *E03F 5/0408* (2013.01)

(58) Field of Classification Search
CPC ..... E03F 5/0407; E03F 5/0408; A47K 3/40; A47K 3/283; A47K 3/405; E03C 1/22
USPC ..... 4/612, 613, 614, 679, 695; 49/471; 16/357, 361; 210/123, 163
See application file for complete search history.

(56) References Cited

U.S. PATENT DOCUMENTS

| | | | | |
|---|---|---|---|---|
| 3,457,568 | A * | 7/1969 | Amatruda | 4/613 |
| 2008/0014021 | A1* | 1/2008 | Flury | 405/94 |
| 2009/0000025 | A1* | 1/2009 | Lang et al. | 4/679 |
| 2010/0147752 | A1* | 6/2010 | Jarvis et al. | 210/123 |

FOREIGN PATENT DOCUMENTS

| | | | | |
|---|---|---|---|---|
| CH | 698575 | B1 | 9/2009 | |
| DE | 102004049944 | A1 | 4/2006 | |
| DE | 202010007534 | A1 | 10/2010 | |
| DE | EP2236683 | * | 10/2010 | E03F 5/0408 |
| DE | 202011000278 | U1 | 7/2011 | |
| DE | 202011051310 | U1 | 12/2011 | |
| DE | 202011105715 | U1 | 1/2012 | |
| EP | 1961879 | A1 | 8/2008 | |
| EP | 2236683 | B1 | 10/2010 | |
| EP | 2405062 | A1 | 1/2012 | |

(Continued)

OTHER PUBLICATIONS

European Patent Office, "Search Report issued by the European Patent Office in co-pending European Application No. 14001856.5", Oct. 22, 2014, 11 pages, Munich, Germany.

Wedi GMBH, "Water Drainage Device for a Sanitary Facility, Such as a Floor-Level Shower Area", co-pending U.S. Appl. No. 14/290,116, filed May 29, 2014.

(Continued)

*Primary Examiner* — Huyen Le
*Assistant Examiner* — Nicholas Ros
(74) *Attorney, Agent, or Firm* — The Law Office of Michael E. Kondoudis

(57) ABSTRACT

A superstructure system for a drain located in the floor region of a wash area or shower stall, including a cover box which is to be placed over the drain and has a closed rear side and top and end faces connecting the rear side and the top, a side which is open toward the drain and a visible side which is open toward the water collection element of the drain, and in which a cover flap (10) is vertically oriented, the lower face of which, when installed, delimits a drain slot of the superstructure system and is connected to the cover box by way of a hinge so as to be horizontally pivotable.

11 Claims, 7 Drawing Sheets

(56) References Cited

FOREIGN PATENT DOCUMENTS

| | | | |
|---|---|---|---|
| FR | 2625244 | A1 | 6/1989 |
| WO | 90/11406 | A1 | 10/1990 |

OTHER PUBLICATIONS

German Patent and Trade Mark Office (DPMA), "Office Action issued in co-pending German Patent Application No. 102013105544.3", Feb. 10, 2014, 6 pages, Munich, Germany.

* cited by examiner

COVER BOX FOR A SHOWER FLOW SYSTEM

BACKGROUND

The invention relates to a superstructure system for a drain located in the floor region of a wash area or shower stall, comprising a cover box which is to be placed over the drain having a closed rear side and top and end faces connecting the rear side and the top, a side which is open toward the drain and a visible side which is open toward the water collection element of the drain and in which a cover flap is vertically oriented, the lower face of which, when installed, delimits a drain slot of the superstructure system and is connected to the cover box by way of a hinge so as to be horizontally pivotable. The invention further relates to a set of gauges consisting of several gauges.

Such a device is known from EP 2 236 683 A1. This is a shower drain channel assembly for installation in a wall, also comprising the channel body having a lateral opening so as to allow shower water to enter the channel body.

However, this design is not suitable for a floor construction in which a channel is already present, especially in a shower tray which is recessed in a quadrate cavity and is factory-fitted with the channel. Such channels are generally provided with covers that are flush with the floor.

The aforementioned design is not suitable if, with such a starting situation, it is desired for an inlet slot to be shaped vertically toward the drain and the channel.

The object is therefore to create a cover which satisfies both the aesthetic and the technical requirements, and in particular a cover for a drain located in the floor region of a wash area or shower stall. A further object is to propose a set of gauges, so as to provide gauges by which the panel supporting the pin can be adjusted in accordance with the installation situation.

This object is achieved by a superstructure system of the type mentioned above, in which the hinge comprises at least one pin which projects horizontally inward on an inner surface of an end face, wherein a hinge opening element that is compatible with the pin is attached laterally on the cover cap and receives the pin so as to be rotatable in an almost circular hinge opening and engageable with the hinge opening and disengageable therefrom.

Further technically advantageous refinements are described in the dependent claims.

For example, the hinge and opening element may comprise a bracket which extends over the pin and slides thereon with drag, the inside edge of the bracket, together with the outside edge of a flat part connected to the cover flap, forming the hinge opening and a diverging mouth opening extending therefrom.

The bracket and flat part of the hinge opening element are preferably cut as one piece from sheet metal, wherein in a further refinement, the flat part has at least one insertion tab which is cut out of the material of the flat part and connected to a flat side of the cover flap that is bent parallel to the end face.

So as to achieve improved locking of the cover flap connected to the hinge opening element, the end of the bracket is provided with a projecting finger, which can be latched in and unlatched from an opening in the region of the face wall supporting the pin.

The pin can be fastened to a panel which is connected to the face wall. This provides a further option of allowing the panel to be aligned horizontally and vertically by means of stud bolts or the like which can be adjusted in cut-outs.

The cover flap may comprise a flat side and a frame side having bent walls, wherein the frame side can be provided with a space-occupying mounting, for example tiles, while the flat side also selectively provides a visible side having a different appearance.

It will also be pointed out that the drain is preferably designed as a drain channel, to this end the cover box preferably has a cuboid shape.

However, it will also be possible for the drain to be designed as a localized floor drain, which then preferably serves as a corner outlet. In this latter case, the superstructure system runs, corresponding to a hypotenuse, between the corner regions of the shower tray which are located perpendicularly to each other.

For installation, a set of gauges that has been found to be advantageous comprises a plurality of gauges which can be used to adjust the panel supporting the pin in accordance with the installation situation, wherein each gauge comprises a lug having a borehole that can be placed over the pin and a strip which is rigidly connected to the lug and can be placed against the outside of the cover box.

DETAILED DESCRIPTION

Figure 1:
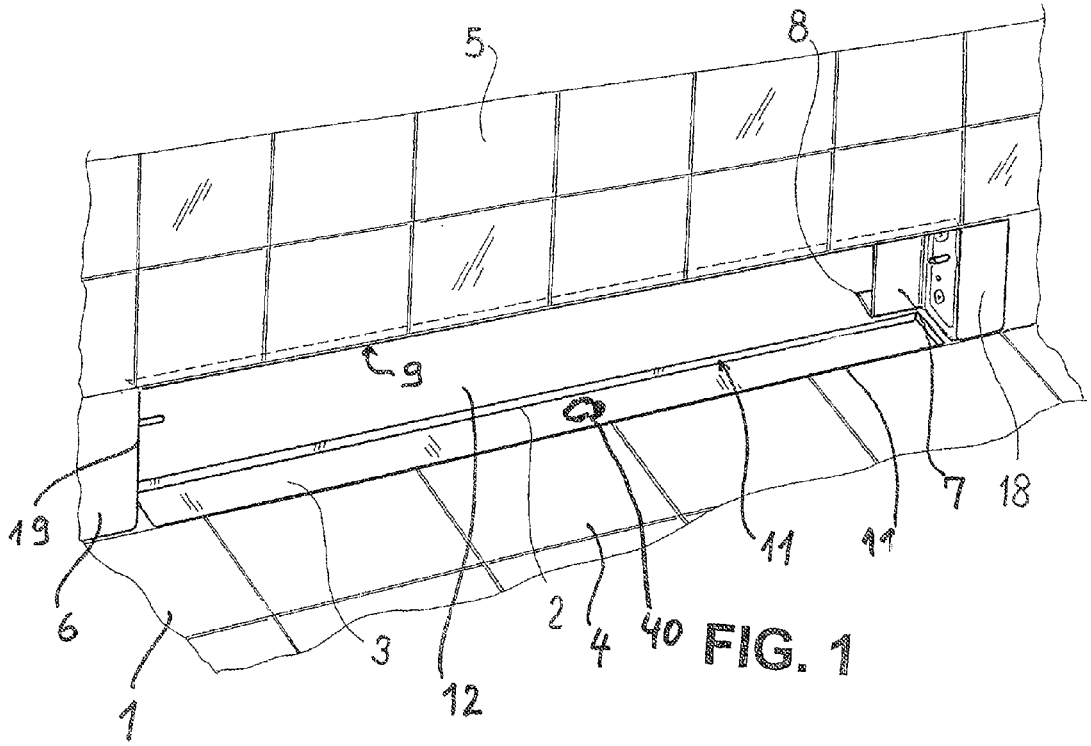
FIG. 1 is a superstructure system over a channel, but without cover flap.
Figure 2:
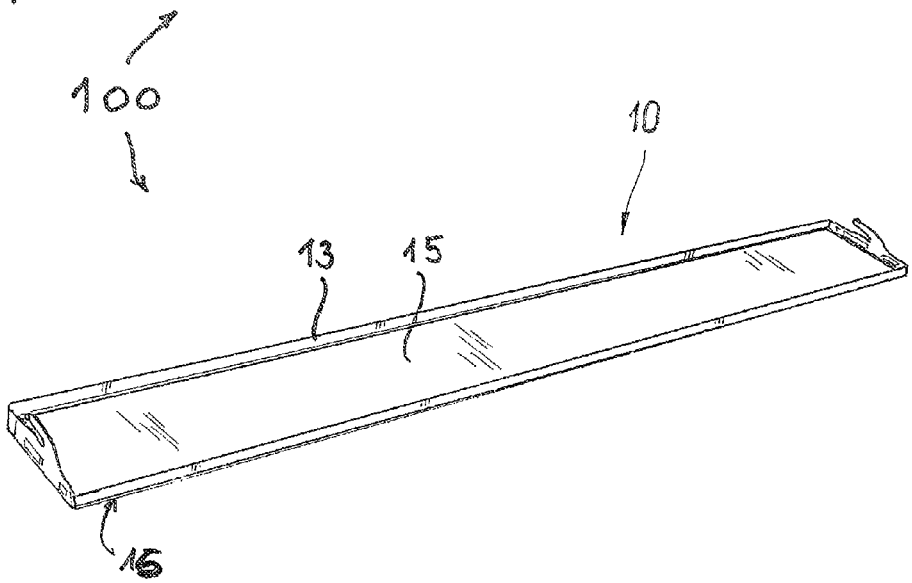
FIG. 2 shows a cover flap for the superstructure system according to FIG. 1.

FIGS. 1 and 2 show separate illustrations of a superstructure system 100 for a shower stall in a walk-in design. This is based on a known shower tray 1, having a wet or dry construction, which is inserted in a quadrate depression and provided with a factory-fitted channel 2, to the channel sump of which a drain pan connects, which is located beneath the drain opening 40. At the shortest distance, the channel 2 is located approximately 200 mm away from the edge of the shower tray 1. The shower tray may be covered with ceramic or synthetic flooring, wherein corresponding dimensions of the superstructure system are to be provided. Such shower trays 1 comprising corresponding channels and drain installation elements are known. The channel 2 is completely covered by a drain strainer that is level with the floor if no superstructure system is provided.

If a channel assembly is desired in which the drain is virtually invisible, a cover for the channel must be created by means of a superstructure system 100, between the channel 2 and stepping area 4 of the shower stall, the cover allowing a wall 5 to be constructed thereon, which can have differing heights and may extend as far as the ceiling. The wall can also be part of one or more lateral walls of a shower enclosure.

A separate channel body (see EP 2 236 683 A1) is no longer required with such a cover design. However, it is desirable for the channel 2 to remain accessible from time to time for cleaning purposes.

Figure 6:
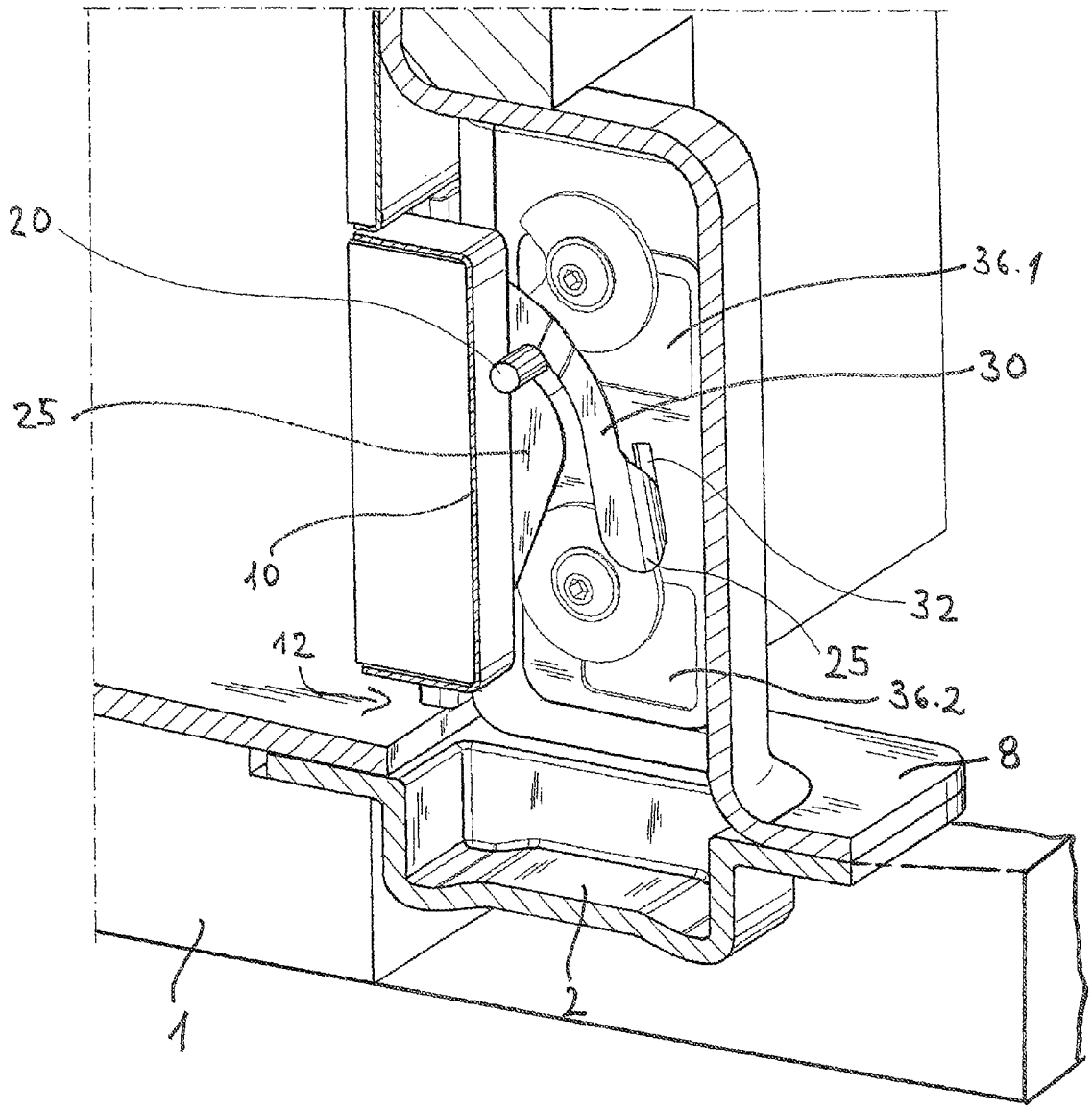
FIG. 6 shows a detail of the corner region of the superstructure system comprising a cover flap and hinge region.

The superstructure system 100 described hereafter comprises a cover box 6, which is placed over the channel 2 and is made of plastic material, and has a closed rear side 7, which ends in a horizontal base land 8 facing away from the stepping area 4. The base land 8 may be glued in the region thereof to a corresponding land of the channel 2 (FIG. 6). However, the superstructure is typically placed on the tiles. A closed top 9 forms an upward closure. The rear side 7 and top 9 are connected laterally by end faces 18 and 19. The cover box 6 is open toward the bottom, which is to say toward the drain. The visible side 11, which receives the water arriving from an outlet region (not illustrated), has an opening 12 extending over the length of the channel 2.

This also allows the channel 2 and the associated opening 12 to take up only a small portion of the superstructure. In addition, the superstructure may be wider than the shower stall. The length of the channel can also be substantially shorter than the length of the cover flap.

Figure 3A:
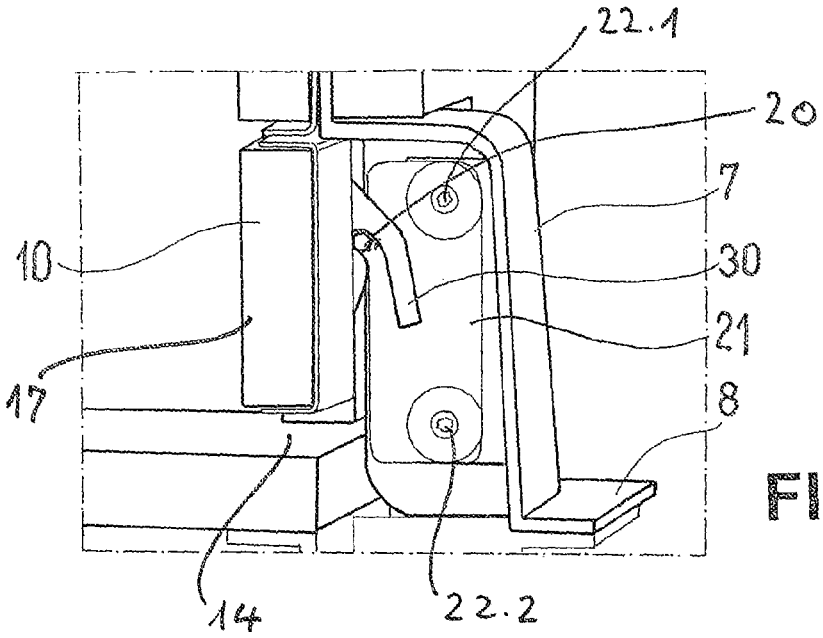
FIGS. 3*a-c* show movement phases for the cover flap.
Figure 3B:
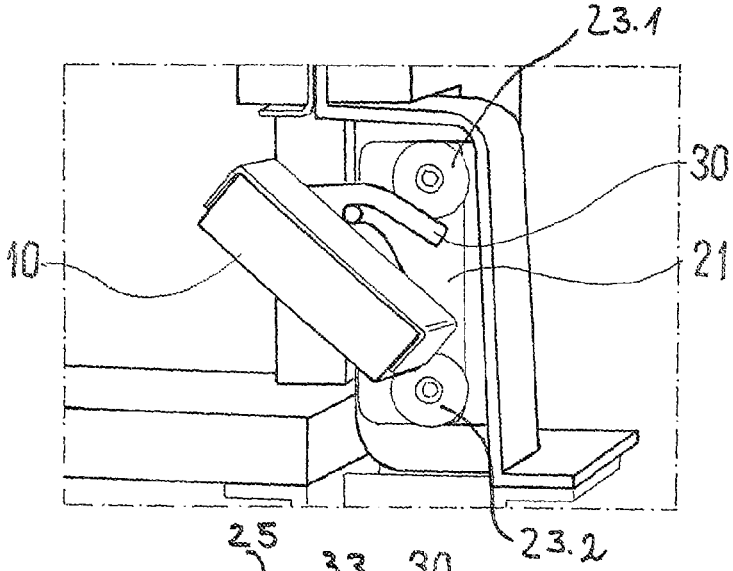
Figure 3C:
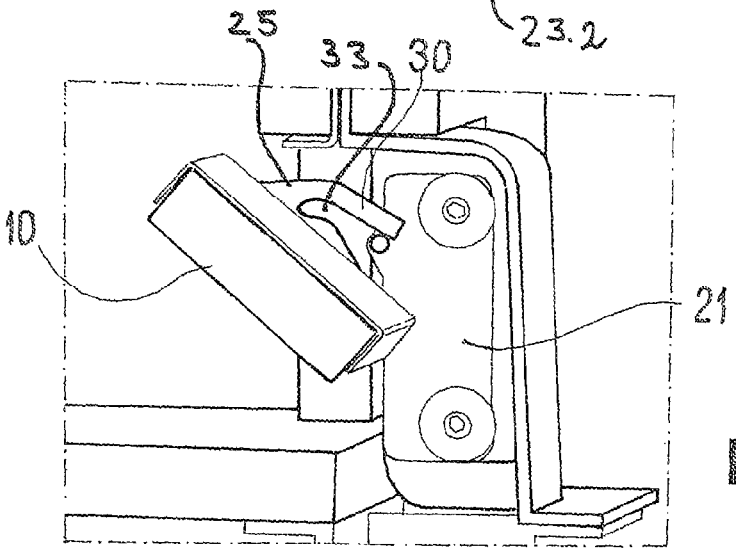

A cover flap 10 (FIG. 2), which is detachably connected to the cover box 6 so as to be horizontally pivotable, is installed in front of the opening 12. When installed, the lower face 13 of the cover flap 10 delimits a drain slot 14; after the pivot mechanism is released, the cover flap 10 can be removed from the opening 12 and, inversely, can also be reinserted therein. The cover flap 10 is made of torsion-resistant plastic material or, preferably, of stainless steel sheet metal. While the front 15 is flat and smooth, the rear of the cover flap 10 can be a frame side 16, which can be provided with a space-occupying mounting 17, for example tiles, as is shown in FIGS. 3*a* to 3*c*, for example.

As a key function of the cover flap 10, the flap can be horizontally pivoted. In this regard, see FIGS. 3*a* to 3*c*, which show various movement phases of a "cut" end of the cover flap 10. A panel 21 is screwed to the inside of each of the two end faces 18, 19 of the cover box 6, two screws 22.1 and 22.2 being used for this purpose, underneath each of which a relatively large washer 23.1, 23.2 has been placed. The end face 18 is provided with oversized cut-outs 36.1, 36.2 (see FIG. 6), the surface areas of which are larger than the diameters of the shafts of the screws 23.1 and 23.2. This allows the panel 21 to be variably adjusted relative to the end face 18, when the screws are loosened, and to subsequently be fixed, more specifically both in the horizontal and in the vertical directions. The adjustment option is required because differing heights of tread surfaces within the stepping area 4 or thicknesses of wall coverings necessitate differing positions for the superstructure system.

The panel 21 bears a pin 20, which projects horizontally inward on the inner surface of the end face 18, which is to say into the interior of the cover box 6. The pin 20 has a length of only approximately 10 mm and a diameter of approximately 3 mm. An identical panel having a pin 20 is arranged in a manner that is mirror symmetrical to the panel 21 on the opposing end faces of the cover box 6. The corresponding connecting parts are compatible and exchangeable with one another, so that the cover panel 10 can be installed in the desired position (smooth side or box-shaped side facing forward) using the same parts, which must only be laterally reversed.

Figure 5A:
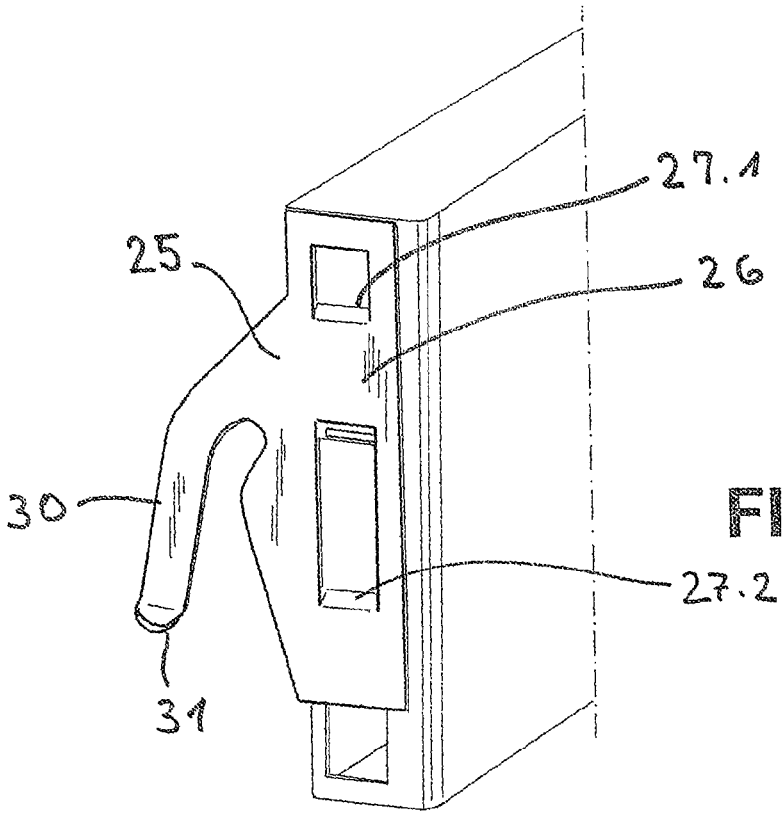
FIGS. 5*a/b* show a fastening option of the hinge opening system on the cover flap.
Figure 5B:
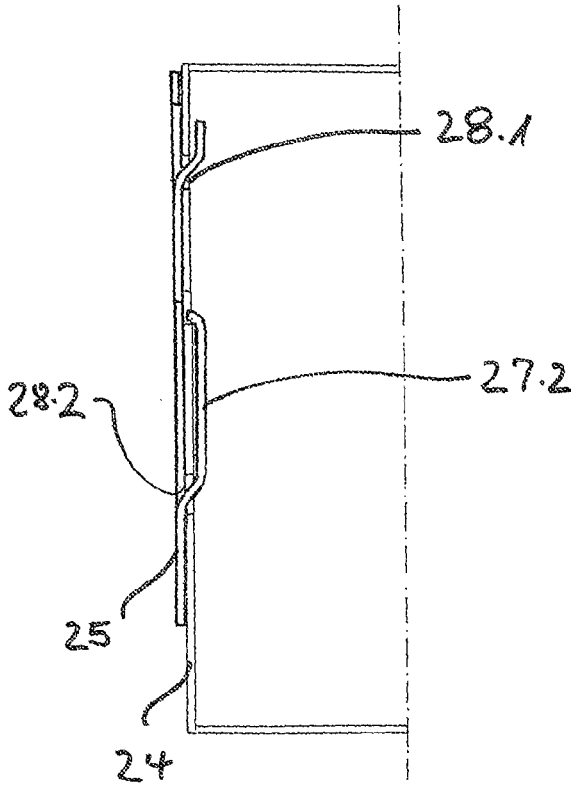

A hinge opening element 25, which cooperates with the pin 20, is attached to the outside of the cover flap 10 where, due to the frame configuration, a retaining wall 24 projects vertically, see FIG. 5*a*. The hinge opening element 25 is non-positively and positively held with a flat part 26 against the retaining wall with the aid of two insertion tabs 27.1 and 27.2, which engage through slots 28.1 and 28.2 in the retaining wall 24. The attachment is thus achieved without a screw connection, with an extremely flat design (see FIG. 5*b*).

In addition to the flat part 26, the hinge opening element 25 comprises a bracket 30, which extends over the pin 20 and slides thereon with drag and which is integrally connected to the flat part 26. The cross-sectional shape of the bracket 30 approximately resembles that of an elephant's trunk and ends in a finger 31 which is bent toward the panel 21. When the cover flap 10 is closed (see FIG. 3*a*), the finger 31 latches in a detent opening 32 which is introduced as a borehole in the panel 21, whereby the cover panel 10 is held closed until the finger 31 is pulled out of the detent opening 32 against a counter-force and the cover panel 10 can be pivoted out (see FIG. 3*b*).

Figure 4:
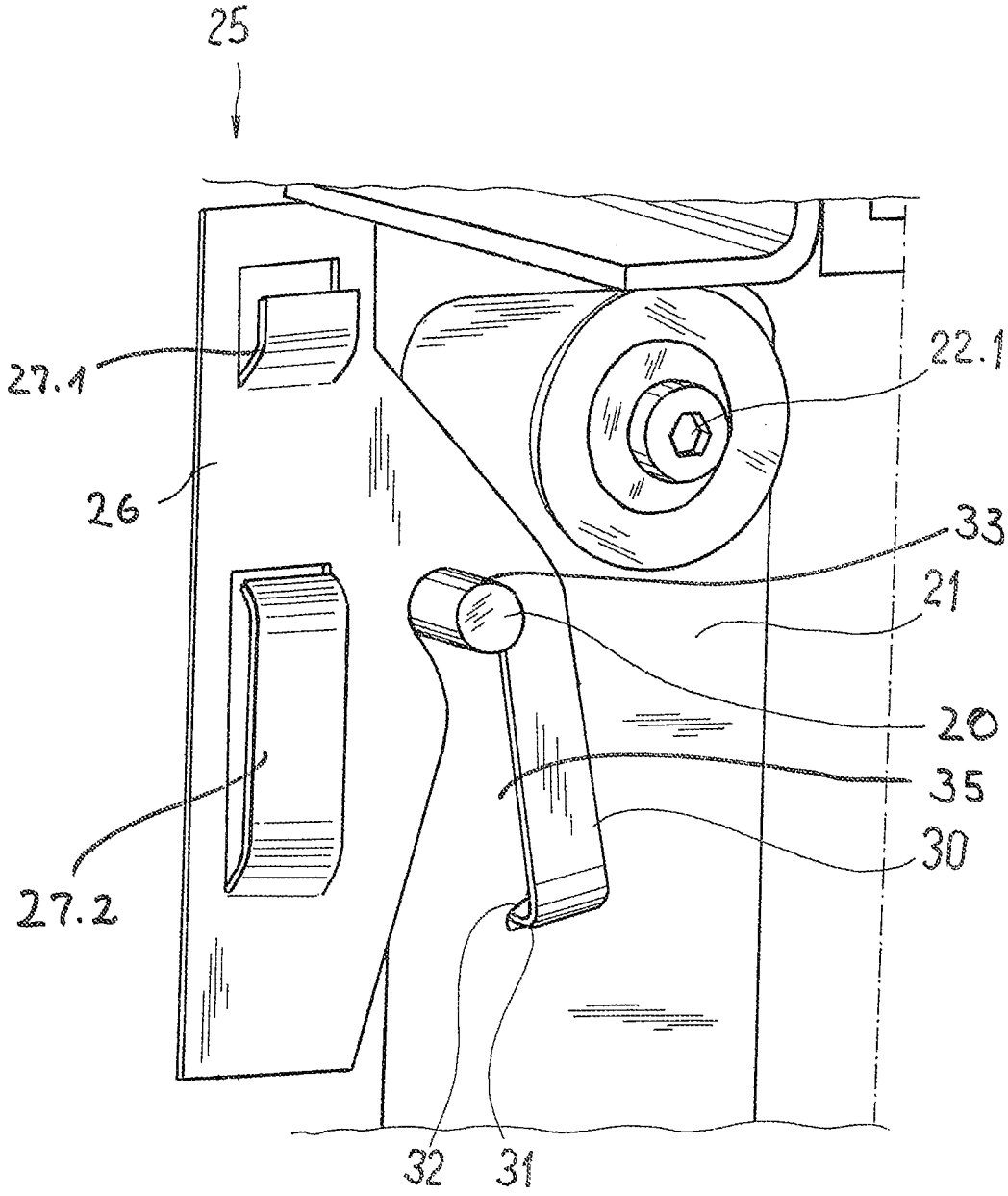
FIG. 4 shows the hinge region of the cover flap in detail.

FIG. 4 shows the hinge opening element 25 without a connection to the cover flap. The bracket 30 and the flat part 26 form an almost circular hinge opening 33, in which the pin 20 is rotatably held as long as a tilting motion of the cover flap does not exceed a pivot angle of approximately 45° (see FIG. 3*b*). A downwardly (FIG. 4) diverging mouth opening 35 extends from the hinge opening 33, and the pin 10 can slide out of the mouth opening when the detent connection of the finger 31 with the detent opening 32 has been released (FIGS. 3*b*/3*c*).

The pin 10 and hinge opening element 25 thus enable cooperation, in which the pin 10 is held rotatably in the hinge opening 33, so that the cover flap 10 can be pivoted in an initially small opening, however the cover flap can also be removed when the hinge opening element 25 has been pulled off the pin 10.

FIG. 6 illustrates the elements of the opening mechanism. It shows that the panel 21 is provided with relatively large cut-outs 36.1 and 36.2, which are covered by the washers 23.1 and 23.2 with only partial overlap. The detent opening 32 is located between the two cut-outs 36.1 and 36.2.

Figure 7:
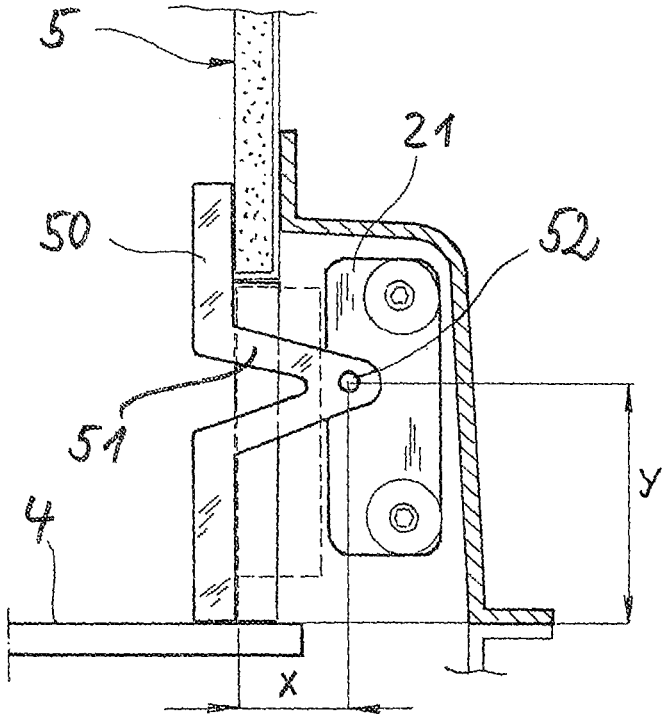
FIG. 7 is a schematic illustration of a mounting situation in the hinge region with a gauge.

The arrangement of the panel 21 with the pin 20 can be exactly adjusted so as to adjust the cover panel 10 flush with the opening and in terms of the height. However, the panel 21 cannot be adjusted if the cover panel 10 has already been inserted. For this purpose, a gauge 50 must be created for all potential installation situations, the gauge consisting of a metal strip having a protruding lug (see FIG. 7). The lug 51 comprises a borehole 52, which can be placed over the pin 20.

When the cover cap 10 is removed, the pin is held with the gauge 50, and the bottom screw 22.2, along with the washer 23.2, is fixed so as to align the panel 21, after the metal strip has been placed against the cover box. Thereafter, the pin 20 is positioned. The top screw 22.1 is also tightened. The cover flap 10, together with the hinge opening element 25, can be pivotably inserted.

Figure 8:
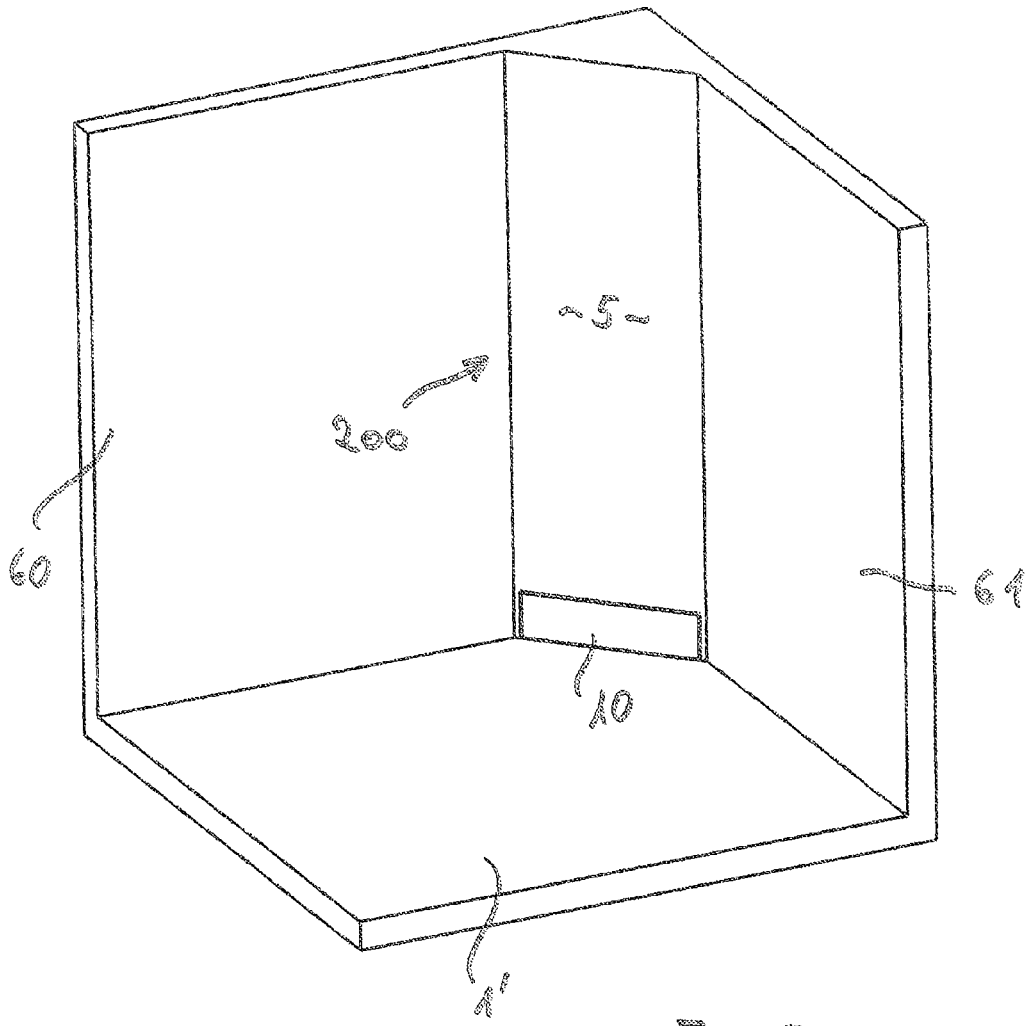
FIG. 8 is a schematic illustration of a superstructure system in the corner of a shower stall.

FIG. 8 shows a schematic illustration of a shower stall, in which two walls 60 and 61 and the shower tray 1' are integrally produced from a coated foam plastic material. The drain is located in the corner between the walls 60 and 61. A superstructure system 200 is installed flush with the inner sides of the walls over the drain. The wall 5 of the superstructure system 200 extends over the height of the walls and in the manner of a hypotenuse between the inner sides of the walls, which form the catheti. The drain for the outflow, which is introduced into the shower tray 1', is located behind the cover flap 10, installed in the base of the superstructure system 200. The pivot mechanism of the cover flap 10 corresponds to the one which is shown in FIG. 6 and described accordingly.

The invention claimed is:

1. A superstructure system (100) for a drain located in the floor region of a wash area or shower stall, comprising a cover box (6) which is to be placed over the drain and has a closed rear side (7) and top (9) and end faces (18, 19) connecting the rear side and the top, a side which is open toward the drain and a visible side (11) which is open toward the water collection element of the drain and in which a cover flap (10) is vertically oriented, the lower face of which, when installed, delimits a drain slot (14) of the superstructure system and is connected to the cover box by way of a hinge so as to be horizontally pivotable, characterized in that the hinge comprises at least one pin (20) which projects horizontally inward on an inner surface of an end face, and in that a hinge opening element (25) compatible with the pin (20) is attached laterally on the cover flap (10) and receives the pin (20) so as to be rotatable in an almost circular hinge opening (33) and engageable with the hinge opening (33) and disengageable therefrom.

2. The superstructure system according to claim 1, characterized in that the hinge opening element (25) comprises a bracket (30) which extends over the pin (20) and slides thereon with drag, the inside edge of the bracket, together with the outside edge of a flat part (26) connected to the cover flap, forming the almost circular hinge opening (33) and a diverging mouth opening (35) extending therefrom.

3. The superstructure system according to claim 2, characterized in that the bracket (30) and flat part (26) of the hinge opening element (25) are cut as one piece from sheet metal.

4. The superstructure system according to claim 2, characterized in that the end of the bracket (30) is provided with a projecting finger (31), which can be latched in and unlatched from a detent opening (32) in the region of the face wall supporting the pin (10).

5. The superstructure system according to claim 2, characterized in that the pin (20) is fastened to a panel (21) which is connected to a face wall.

6. The superstructure system according to claim 5, characterized in that the panel (21) can be aligned horizontally and vertically by means of stud bolts (22.1; 22.2) or the like, which can be adjusted in cut-outs (36.1; 36.2) of the panel (21).

7. The superstructure system according to claim 1, characterized in that a flat part (26) is connected to an end face of the cover flap (10) via at least one insertion tab (27.1; 27.2), which is cut out of the material of the flat part (26).

8. The superstructure system according to claim 1, characterized in that the cover flap (10) comprises, on opposing sides, a flat lower face (13) and a frame side (16) having bent walls, wherein the frame side (16) can be provided with a space-occupying mounting, for example with tiles.

9. The superstructure system according to claim 1, characterized in that the drain is designed as a channel (2).

10. The superstructure system according to claim 1, characterized in that the cover box (6) has a cuboid shape.

11. The superstructure system according to claim 1, comprising a triangular base surface area for installation in a corner, wherein a cover panel (10), which extends over the corners in the form of a hypotenuse, is installed in the lower region of the superstructure system (200).

* * * * *